US011535503B2

(12) United States Patent
Kursawe et al.

(10) Patent No.: US 11,535,503 B2
(45) Date of Patent: Dec. 27, 2022

(54) METHOD AND DEVICE FOR FILLING A CONTAINER WITH A FILLING PRODUCT

(71) Applicant: KRONES AG, Neutraubling (DE)

(72) Inventors: Andreas Kursawe, Neutraubling (DE); Florian Habersetzer, Neutraubling (DE)

(73) Assignee: KRONES AG, Neutraubling (DE)

( * ) Notice: Subject to any disclaimer, the term of this patent is extended or adjusted under 35 U.S.C. 154(b) by 119 days.

(21) Appl. No.: 17/024,931

(22) Filed: Sep. 18, 2020

(65) Prior Publication Data

US 2021/0087039 A1 Mar. 25, 2021

(30) Foreign Application Priority Data

Sep. 20, 2019 (DE) ..... 10 2019 125 329.2

(51) Int. Cl.

| | |
|---|---|
| ***B67C 3/20*** | (2006.01) |
| ***B67C 3/00*** | (2006.01) |
| ***B67C 3/26*** | (2006.01) |
| ***B67C 3/06*** | (2006.01) |
| ***B67C 3/16*** | (2006.01) |
| ***B65B 3/12*** | (2006.01) |
| ***B65B 3/26*** | (2006.01) |

(52) U.S. Cl.

CPC ..... *B67C 3/007* (2013.01); *B65B 3/12* (2013.01); *B65B 3/26* (2013.01); *B67C 3/06* (2013.01); *B67C 3/16* (2013.01); *B67C 3/20* (2013.01); *B67C 3/26* (2013.01); *B67C 3/2634* (2013.01); *B67C 3/2637* (2013.01)

(58) Field of Classification Search

CPC .. B67C 3/007; B67C 3/06; B67C 3/16; B67C 3/20; B67C 3/26; B67C 3/2634; B67C 3/2637; B67C 3/22; B65B 3/12; B65B 3/26

See application file for complete search history.

(56) References Cited

U.S. PATENT DOCUMENTS

| | | | | |
|---|---|---|---|---|
| 5,634,500 | A * | 6/1997 | Clusserath | B67C 3/286 141/49 |
| 8,776,839 | B2 * | 7/2014 | Clusserath | B67C 3/06 141/50 |
| 9,862,584 | B2 * | 1/2018 | Clüsserath | B08B 9/20 |
| 10,214,405 | B2 * | 2/2019 | Wagner | B67C 3/262 |
| 10,294,090 | B2 * | 5/2019 | Clüsserath | B67C 3/2628 |

(Continued)

FOREIGN PATENT DOCUMENTS

| | | |
|---|---|---|
| DE | 102014216562 A1 | 2/2016 |
| DE | 102017119069 A1 | 2/2019 |

(Continued)

*Primary Examiner* — Nicolas A Arnett
(74) *Attorney, Agent, or Firm* — Maschoff Brennan

(57) ABSTRACT

Method and filling device for filling a container with a filling product, in a beverage filling system, wherein the method comprises: determining one or more changeable influence variables which influence a target variable of the filling process, a filling level and/or a filling volume; receiving the influence variables by means of a control apparatus; calculating at least one output variable from the received influence variables by means of a calculation model of the control apparatus; and filling the container as a function of the at least one output variable.

18 Claims, 2 Drawing Sheets

(56) References Cited

U.S. PATENT DOCUMENTS

| | | | | |
|---|---|---|---|---|
| 10,836,621 | B2 * | 11/2020 | Meinzinger | B67C 3/10 |
| 2015/0284233 | A1 * | 10/2015 | Meinzinger | B67C 3/16 141/39 |
| 2016/0368751 | A1 * | 12/2016 | Fickert | B67C 3/286 |
| 2019/0106311 | A1 * | 4/2019 | Habersetzer | B67C 3/2614 |
| 2020/0198954 | A1 * | 6/2020 | Angerer | B67C 3/286 |
| 2020/0346911 | A1 * | 11/2020 | D'Errico | B67C 3/286 |

FOREIGN PATENT DOCUMENTS

| | | | |
|---|---|---|---|
| EP | 2927189 | A1 | 10/2015 |
| WO | 2019121151 | A1 | 6/2019 |

* cited by examiner

METHOD AND DEVICE FOR FILLING A CONTAINER WITH A FILLING PRODUCT

CROSS-REFERENCE TO RELATED APPLICATION

This application claims priority to German Patent Application No. 10 2019 125 329.2, filed on Sep. 20, 2019.

FIELD

The present invention relates to a method and a filling device for filling a container with a filling product, in a beverage filling system for bottling beverages such as for example water, which is carbonated or non-carbonated, soft drinks, beer, or mixed beverages.

BACKGROUND

Amongst the different methods and devices for bottling filling products in beverage filling systems, a technology for the abrupt filling of containers which is disclosed, for example, in DE 10 2014 104 872 A1 and DE 10 2014 104 873 A1 is known. In this case, the filling product is provided at an overpressure, the container to be filled is evacuated and the filling product at overpressure is introduced into the container which is at negative pressure. Due to the pressure difference thus produced, the filling product is introduced in an abrupt manner.

In order to shorten the settling time of the filling product after being filled in the container and to prevent the foaming and foaming over of the filling product, according to a development disclosed in DE 10 2014 104 873 A1 the container may be closed at overpressure without the pressure of the container interior being in equilibrium with the external surroundings.

In the overpressure method for abrupt filling, the filling level in the container is not set via a return air pipe or a level sensor, as in a conventional filling device, but influenced by different variables. Thus according to DE 10 2014 104 872 A1 the filling of the container is terminated, for example, when a specific cut-off pressure is reached in the container. The parameters which determine the filling level are, on the one hand, control variables which may be set to the filling device and, on the other hand, properties of the filling product. If an intentional or unintentional variation of such an influence variable takes place, for example, by changing the ambient conditions or the filling product to be bottled, the filling level in the container may also change.

During the filling process, in the case of abrupt filling, the filling device is neither able to measure nor optionally re-correct the filling level in order to reach the desired filling level. If an influence variable changes, such as for example the vacuum pressure, the temperature, or the CO2 concentration of the filling product, it is possible that the containers are underfilled or overfilled. In other words, for example, a constant filling pressure is set and if one or more of the aforementioned parameters changes, a different filling level is produced in the containers which may lead to these containers having to be rejected by a monitoring unit after the filling process.

SUMMARY

A method for filling a container with a filling product in a beverage filling system may include determining one or more changeable influence variables that influence a target variable of a filling process, the target variable being a filling level and/or a filling volume and receiving the influence variables by way of a control apparatus. The method may also include calculating, by the control apparatus, at least one output variable based on the received influence variables using a calculation model and filling the container as a function of the at least one output variable.

BRIEF DESCRIPTION OF THE FIGURES

Preferred further embodiments of the invention are described in more detail by the following description of the figures, in which.

DETAILED DESCRIPTION

Figure 1A:
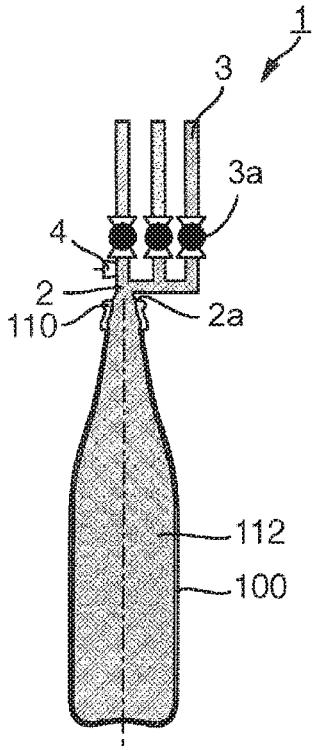
FIG. 1*a* shows a filling device for filling a container, wherein the filling device and the container to be filled are in a first state.

An object of the description is to improve the filling process of a container, in a beverage filling system, in particular to improve the accuracy of the intended filling level or the intended filling volume.

The object is achieved by a method having the features of claim 1 as well as a filling device having the features of the subordinate device claim. Advantageous developments are disclosed in the sub-claims and the description of embodiments.

The method and filling device according to the description serve for filling a container with a filling product. The filling product may be a beverage, such as for example water, which is carbonated or non-carbonated, soft drinks, beer, or mixed beverages.

In the method according to the description, one or more changeable influence variables which influence a target variable of the filling process and/or the value thereof are determined. In particular, the measuring of the influence variable(s) by means of suitable sensors is encompassed by the terms "determination", "determine" etc. However, there is also the possibility that one or more of the influence variables are determined in a different manner, for example calculated, simulated, or estimated, or by the behavior thereof being known or the like. Moreover, a combination of different methods for determining the influence variable(s) is encompassed. Particularly, the filling level and/or the filling volume in the filled container are used as the target variable. Influence variables are, for example, the temperature and/or the CO2 content of the filling product to be bottled. In the case of the evacuation of the container described in more detail below, additionally, or alternatively the negative pressure of the evacuated container and/or the overpressure at which the filling product is provided and bottled may be such an influence variable. No influence variables are the target variables themselves, i.e. the filling level to be achieved and/or the filling volume to be achieved are optimization variables which have to be calculated from the influence variables and, depending on the deviation from the intended target variable(s), lead to an adjustment and/or adaptation of the filling process.

The determined influence variables and/or the values thereof are received by means of a control apparatus. The control apparatus then calculates at least one output variable from the received influence variables by means of a calculation model. In other words, the calculation model of the control apparatus undertakes a pre-calculation as to which value is to be anticipated for the target variable(s) as a function of the received influence variables and determines therefrom the output variable(s). Subsequently, the container is filled as a function of the at least one output variable. In this case, the output variables are determined and/or calculated such that the target variable is substantially constant across a plurality of filling processes. Thus normally a specific filling level, which is intended to be kept constant with a high level of accuracy, is desired. However, in the case of a product changeover, changing the container type or for other reasons, a change to the filling level or the filling volume may also be intended. Generally, therefore, the output variables are determined and/or calculated such that during the bottling process a specific, intended value of the target variable(s) is achieved as far as possible.

By such a pre-calculation, containers may be produced with a high degree of accuracy with the intended filling level and/or with the intended filling volume, in particular with a uniform filling level and/or uniform filling volume, even under changing process conditions and without monitoring the filling level during the filling. Fluctuations of the influence variables of the filling process which arise, such as for example the temperature of the filling product and/or vacuum pressure, are measured, for example, at defined time intervals and for example the filling pressure, vacuum pressure or the dead space volume are calculated and adapted by means of the calculation model. Thus the process parameters are dynamically adapted to fluctuations in order to counteract changes to the filling level or the filling volume. The calculation model additionally permits the production to be started up without significant fluctuations since it is possible to react to dynamic changes, such as for example the gradual heating up of the filling product in a product bowl. The filling level is not set via a return air pipe or a level sensor. For this reason the method is particularly suitable for the abrupt filling described below.

Before introducing the filling product the container is evacuated to a negative pressure. The filling product is provided at an overpressure and introduced into the evacuated container.

The terms "negative pressure" and "overpressure" are to be initially understood herein relative to one another. However, after the evacuation the negative pressure is below atmospheric pressure (=normal pressure). The overpressure of the filling product may correspond to the atmospheric pressure but is above atmospheric pressure. Thus before introducing the filling product the container is evacuated to a negative pressure with an absolute pressure of 0.5 to 0.05 bar, 0.3 to 0.1 bar, particularly approximately 0.1 bar. The overpressure of the filling product is above atmospheric pressure, approximately at an absolute pressure of 1 bar to 9 bar, 2.5 bar to 6 bar, particularly 2.8 bar to 3.3 bar.

In this manner, the container is evacuated such that, when filled with the filling product, substantially no gas is displaced by the filling product and correspondingly no gas has to flow out of the interior of the container. Instead, the entire mouth cross section of the container may be used for introducing the filling product. In other words, during the filling process, only a filling product flow which is oriented into the container is present, rather than an opposing fluid flow.

The filling of the container is terminated by taking into account the pressure curve in the container during the filling. Thus the filling may be terminated, for example, when reaching a predetermined cut-off pressure in the container and when reaching a predetermined rise in pressure. The filling process is terminated by a filling valve, which is arranged in the filling product line, being closed.

As the termination of the filling process is carried out using the pressure curve, which is produced during the filling process, an effective metering accuracy may be achieved. In this case the metering accuracy is independent of the flow rate of the filling product and the filling time. The metering accuracy is also independent of the volume to be bottled and, in particular, is also able to be used for filling containers with small volumes of 0.2 l to 5 l. In this manner, even an abrupt filling may be terminated in a reliable manner when reaching the desired filling volume and/or the desired filling level.

For carrying out the method only a determination of the pressure of the container to be filled is required so that the constructional effort is small. In preferred embodiments, for example, it is possible to provide a central pressure gauge or a pressure gauge at each filling member of a beverage filling system, for example of a carousel-type filling machine.

As mentioned above, the changeable influence variables comprise: the temperature and/or the CO2 content of the filling product to be bottled and/or the negative pressure of the evacuated container and/or the overpressure at which the filling product is provided. Sensors are often present in any case for monitoring one or more of these parameters and thus may be used synergistically for the pre-calculation.

The at least one output variable comprises: the overpressure of the filling product, at which the bottling process is carried out, and/or the negative pressure of the evacuated container and/or the cut-off pressure and/or a dead space volume. By adjusting one or more of these parameters the filling level and/or the filling volume is able to be set in a structurally simple manner which is specific to the containers, in particular is able to be kept constant.

According to a first variant, the calculation model, for example, calculates for each measuring point a required filling pressure for a defined target variable. If the current filling pressure deviates from the calculated reference pressure, it is re-adjusted. The current filling pressure may be determined, for example, by a pressure gauge in a product bowl which delivers the filling product to the respective filling stations and/or by the pressure gauge in the filling product line. As an alternative procedure, the negative pressure may also be calculated and regulated at a constant filling pressure. The negative pressure in the container and/or in a vacuum line may be measured and utilized therefor. According to a third variant, the dead space volume in the filling product line is kept variable, whereby in turn a constant filling level and/or a constant filling volume in the container may be achieved. The dead space volume, for example, may be varied by a punch and/or a piston which is movable in a corresponding portion of the filling product line or in a chamber branching off therefrom.

The one or more changeable influence variables are determined at defined time intervals and received by the control apparatus, whereby a continuous updating of the influence variables is carried out. In this manner, the filling process may be effectively adapted continuously to small changes of the influence variables.

For the same reason, the calculation of the at least one output variable from the received influence variables is carried out for each filling process, regulated as required, or at defined time intervals or filling intervals.

After terminating the filling process the filling level or the filling volume in the filled container is determined in order to adjust the calculation model as a function thereof. In particular, the filling level or the filling volume may be measured retrospectively, intermittently, at specific intervals or even for each filled container. Thus, for example, any variation in the head space volume by degassing the gases contained in the filling product may be determined by a filling level measurement and taken into account for subsequent bottling processes in the calculation model. If too much degassing takes place this may be compensated, for example, by adapting the temperature of the filling product to be bottled.

For determining the end of the filling process neither the filling level nor the bottled volume are determined or utilized since, in particular in the case of the abrupt bottling process, this might be associated with a significant constructional effort and thus associated problems of reliability and maintenance.

For the reasons set forth above, the calculation of the at least one output variable from the received influence variables by means of the calculation model is carried out such that the target variable adopts a predetermined value and remains substantially constant across a plurality of filling processes.

The aforementioned object is further achieved by a filling device for filling a container with a filling product, in a beverage filling system. The filling device has: a filling member with a filling product line for introducing the filling product into the container; means for determining one or more changeable influence variables which influence a target variable of the filling process, the filling level and/or the filling volume in the filled container; and a control apparatus which is designed to receive the determine influence variables, to calculate at least one output variable from the received influence variables by means of a calculation model and to activate the filling member such that the container is filled as a function of the at least one output variable. In this case, the output variables are determined and/or calculated such that the target variable is substantially constant across a plurality of filling processes. Thus normally a specific filling level, which is intended to be kept constant with a high degree of accuracy, is desired. However, in the case of a product changeover, changing the container type or for other reasons, a change to the filling level or the filling volume may also be intended. Generally, therefore, the output variables are determined and/or calculated such that during the bottling process a specific, intended value of the target variable(s) is achieved as far as possible.

The features, technical effects, advantages, and embodiments which have been described relative to the method apply equally to the filling device.

Thus, for the reasons set forth above, the filling device is designed to evacuate the container to be filled to a negative pressure, to an absolute pressure of 0.5 to 0.05 bar, particularly 0.3 to 0.1 bar, and to provide the filling product at an overpressure, at an absolute pressure of 1 bar to 9 bar, particularly 2.5 bar to 6 bar and to introduce the filling product into the container.

For the aforementioned reasons, the control apparatus of the filling device is designed to terminate the filling process of the container by taking into account the pressure curve in the container during the filling, when reaching a predetermined cut-off pressure in the container or when reaching a predetermined rise in pressure.

For the aforementioned reasons, the means for determining one or more changeable influence variables comprise: a temperature sensor for measuring the temperature of the filling product to be bottled and/or a CO2 sensor for measuring the CO2 content of the filling product to be bottled and/or a pressure gauge for measuring the negative pressure of the evacuated container and/or a pressure gauge for measuring the overpressure at which the filling product is provided.

For the aforementioned reasons, the at least one output variable comprises: the overpressure of the filling product at which the bottling process takes place and/or the negative pressure of the evacuated container and/or the cut-off pressure and/or a dead space volume.

For the aforementioned reasons, the filling product line comprises a changeable dead space volume which is variable by an output variable of the control apparatus.

For the aforementioned reasons, the control apparatus is designed to receive the one or more changeable influence variables at defined time intervals and/or to carry out the calculation of the at least one output variable from the received influence variables for each filling process, regulated as required, or at defined time intervals or filling intervals.

For the aforementioned reasons, the control apparatus is designed such that the calculation of the at least one output variable from the received influence variables takes place by means of the calculation model such that the target variable adopts a predetermined value, and is substantially constant across a plurality of filling processes.

Further advantages and features of the present description may be derived from the following description of embodiments. The features described therein may be implemented individually or in combination with one or more of the features set forth above, insofar as the features do not contradict one another. In this case, the following description of embodiments is made with reference to the accompanying drawings.

Embodiments are described hereinafter with reference to the figures. In this case, elements which are identical, similar, or functionally identical are provided in the figures with the same reference numerals and a repeated description of these elements is in some cases dispensed with in order to avoid redundancies.

Firstly, embodiments for the abrupt filling of a container 100 are described with reference to FIGS. 1*a*, 1*b*, 1*c* and 2. The pre-calculation of the filling level and/or the filling volume, which may be used for these and other embodiments, is set forth hereinafter.

In FIG. 1*a* a filling device 1 is shown for filling a container 100 to be filled with a filling product. The filling device 1 comprises a filling member indicated only schematically with a filling product line 2 and a mouth section 2*a* which is configured, for example, as a gripping bell. A container mouth 110 of the container 100 to be filled may be received in a pressure-tight manner in the gripping bell. Correspondingly, the interior 112 of the container 100 to be filled may be communicatively connected for the filling thereof in a pressure-tight manner to the filling product line 2.

A vacuum line 3 is provided, said vacuum line being able to be brought into a connection via a vacuum valve 3*a* with the filling product line 2 and thus also with the interior 112 of the container 100 to be filled. The vacuum line 3 provides a negative pressure approximately in the range of an absolute pressure of 0.5 bar to 0.05 bar, 0.3 to 0.1 bar, particularly of 0.1 bar, so that in the interior 112 of the container 100 after a certain time a negative pressure corresponding thereto is set, at an absolute pressure of for example 0.5 bar to 0.05 bar, 0.3 to 0.1 bar, particularly of 0.1 bar.

Correspondingly, in the state shown schematically in FIG. 1*a* in which the vacuum valve 3*a* is open, the container 100 to be filled may be brought to a predetermined negative pressure which is determined, for example, via a pressure gauge 4 as an initial pressure PAU. The pressure gauge 4 communicates with the filling product line 2 and correspondingly also with the interior 112 of the container 100 to be filled. After closing the vacuum valve 3*a* the pressure prevailing in the interior 112 of the container 100 may also be correspondingly determined via the pressure gauge 4.

Alternatively, the pressure gauge 4 may also be provided in the vacuum line 3 or at the vacuum source itself, not shown here, for example a vacuum pump. The pressure gauge 4 initially permits only that the initial pressure PAU in the container 100 to be filled is able to be determined. If the pressure gauge 4 is arranged in the vacuum line 3 or at the vacuum source itself, it is possible to assume that the pressure provided in the vacuum line 3 and/or provided by the vacuum source after a short length of time also prevails in the interior 112 of the container 100 to be filled. Thus the pressure may also be reliably determined in the interior 112 of the container 100 to be filled by a pressure gauge 4 arranged in the vacuum line 3 or at the vacuum source.

Figure 1B:
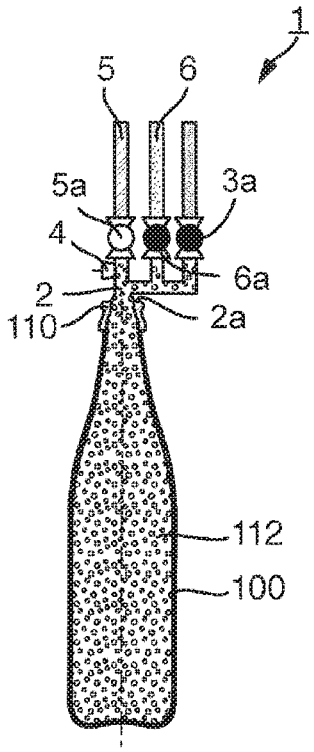
FIG. 1*b* shows the filling device with the container of FIG. 1*a* in a second state.

In FIG. 1*b* the filling device 1 is shown in a second method state. The vacuum valve 3*a* is closed and a filling valve 5*a* is open and correspondingly provides a connection between the filling product feed 5 and the interior 112 of the container 100 to be filled via the filling product line 2. Correspondingly, the filling product present in the filling product feed 5 may be introduced into the container 100.

The filling product in the filling product feed 5 is particularly provided at an overpressure relative to the initial pressure PAU present in the container 100 to be filled, for example at an absolute pressure of 1 to 9 bar.

The terms "negative pressure" and "overpressure" are initially to be understood relative to one another. The overpressure is correspondingly to be regarded as overpressure relative to the negative pressure formed in the container 100 to be filled, so that a pressure gradient is present between the provided filling product and the container 100. However, the negative pressure after evacuation is below atmospheric pressure (=normal pressure of ca. 1 bar). The overpressure at which the filling product is provided may correspond to atmospheric pressure but is above atmospheric pressure.

The overpressure of the filling product may also correspond to the saturated pressure of the filling product and may be at an absolute pressure of 1.1 bar to 6 bar. Due to the overpressure being at the respective saturated pressure, a liberation of CO2 in the case of a carbonated filling product may be counteracted.

In a development, the overpressure of the filling product is above the saturated pressure of the filling product and below an absolute pressure of 1.6 bar to 9 bar. By means of a high overpressure which, in particular, is above the saturated pressure of the filling product, it may be achieved that the CO2 is at saturation in the filling product, and at the same time the pressure gradient is greater between the provided filling product and the container 100 to be filled in order to accelerate the filling process further.

As in the interior 112 of the container 100 to be filled a negative pressure is present and the filling product in the filling product feed 5 is provided at an overpressure, an abrupt filling of the container 100 to be filled is implemented. The end of the filling process is determined by considering the pressure curve in the container 100 during the filling process. For example, the filling valve 50 is closed as soon as a predetermined cut-off pressure PAB is present in the container 100 to be filled and thus the desired volume of filling product is present. The pressure gauge 4 in the filling product line 2 may be used to this end. Alternatively, the pressure curve in the container 100 may be measured, wherein when reaching a predetermined rise and/or a predetermined differential dp/dt of the pressure, the filling process is terminated by the filling valve 5*a* being closed.

In order to determine when the filling process has to be terminated a control apparatus, described in more detail below, determines the proportion of filling product which may be introduced into the container 100 to be filled until a pressure equilibrium is present or a predetermined cut-off pressure PAB is reached, for example on the basis of the initial pressure PAU in the container 100 to be filled, which was determined before opening the filling valve 50.

In other words, the pressure curve in the container 100 to be filled during the filling process is dependent on the initial pressure PAU in the container 100 to be filled at the start of the filling process, and thus also on the residual gas located in the container 100. The container 100 is filled by the filling product such that the filling product shares the remaining space with the residual gas. Correspondingly, the pressure in the container 100 rises. By the resulting pressure curve, therefore, the respective filling state of the container 100 may also be determined and, for example, starting from the initial pressure PAU of the unfilled container 100, also the end of the filling process to be reached may be determined on the basis thereof.

For example, in the case of evacuating a container 100 to be filled which has a nominal volume of half a liter, with an assumed head space 113 of 20 ml and an assumed constructional space of the filling product line 2 below the valves 3*a*, 5*a*, 6*a* of 5 ml, a total volume of 525 ml is present, said volume being initially evacuated by opening the vacuum valve 3*a*.

If the vacuum valve 3*a* is then closed and the filling valve 5*a* is opened, as shown in FIG. 1*b*, the total volume of 525 ml is subjected to filling product from the filling product feed 5. Since a negative pressure is present in the container 100 to be filled, relative to the pending filling product in the filling product feed 5, in the described example the filling product is expelled into the container 100 to be filled. If the filling product is a carbonated filling product, a high tendency to foaming is to be anticipated due to the pressure difference. Thus a filling product foam is present in the total volume, consisting of the constructional space in the filling product line 2, the head space 113 and the container interior 112.

If this total volume is evacuated, for example, at an absolute pressure of 0.1 bar, residual gas with a volume of 52.5 ml remains, said residual gas being located in the container 100 to be filled before the filling process. Depending on the pretreatment of the container 100 to be filled, the residual gas is CO2, a different inert gas, air, or a different gas mixture.

Correspondingly, filling product, which is supplied via the filling product feed 5 initially up to normal pressure, i.e. atmospheric pressure, may be fed to the container 100, resulting in a filling quantity of 472.5 ml.

In order to achieve the nominal filling volume of, for example, 510 ml the filling product has to flow on via the filling product feed 5 into the container to be filled and at the same time compress the residual gas, which at atmospheric pressure displaces a volume of 52.5 ml, such that the missing filling quantity of 37.5 ml may be forced therein to reach the desired nominal filling volume of 510 ml.

This results in the filling product having to be filled via the filling product feed 5 at least at an absolute pressure of 1.4 bar, in order to permit the corresponding compression of the residual gas. If the filling product in the filling product feed 5 is at this aforementioned pressure, it results in an equalization of the pressures in the filling product feed 5, the filling product line 2 and the interior 112 of the container 100 to be filled, such that 1.4 bar absolute pressure is present and a total filling quantity of 510 ml is present in the container 100 to be filled.

Correspondingly, for filling a container 100 with a filling product by determining the pressure of the container 100 to be filled before the filling process, it is possible to achieve by the filling device 1 that the filling process is terminated when a predetermined cut-off pressure PAB is reached in the container 100. In the aforementioned embodiment the predetermined cut-off pressure PAB is reached in the container 100 by the filling product being already provided in the filling product feed 5 at the cut-off pressure PAB. Correspondingly, the container 100 to be filled is only filled with the filling product until the pressure prevailing in the interior 112 of the container 100 to be filled and the pressure prevailing in the filling product feed 5 are in equilibrium.

The determination and/or provision of the filling product pressure determines, in combination with the cut-off pressure PAB, the filling volume to be introduced into the container 100 to be filled even before the start of the filling process.

In order to permit an accurate filling of the container 100 to be filled with the filling product, in the described embodiment it may be necessary to introduce a gas lock in the filling product line 2 or the filling product feed 5 in order to prevent, when equalizing the pressures in the container 100, which is then almost completely filled, and the filling product feed 5, a backflow of residual gas from the container 100 into the filling product feed 5. If such a backflow of residual gas into the filling product feed 5 were to be permitted, the container 100 would be overfilled with the filling product. The backflow of residual gas from the container 100, therefore, has to be prevented in order to achieve even more accurate filling results.

In the equilibrium method, in which toward the end of the filling process an equilibrium is present between the pressure prevailing in the interior 112 of the container 100 to be filled and the pressure prevailing in the filling product feed 5, the initial filling process is rapid; toward the end before the actual equilibrium is set, however, the filling process slows down and finally comes to a halt creating the pressure equilibrium.

In a variant, the cut-off pressure PAB, as described above, is established in turn from the determined initial pressure PAU of the container 100 to be filled, for example in turn at a cut-off pressure PAB of 1.4 bar absolute pressure, starting from an initial pressure PAU of 0.1 bar absolute pressure. The filling product in the filling product feed 5 in this variant, however, is at a substantially greater pressure, at an absolute pressure of 1.5 bar to 9 bar.

Via the pressure gauge 4, therefore, when the filling product flows via the filling product feed 5 into the container to be filled, the pressure curve in the interior 112 of the container 100 to be filled may be tracked and when the predetermined cut-off pressure PAB is reached, in the example described of 1.4 bar, the filling valve 5*a* may be closed. Thus the filling valve 5*a* is closed, whilst in the filling product feed 5 a greater pressure prevails relative to the pressure in the container 100 thus filled. By providing the filling product at a pressure in the filling product feed 5 below the predetermined cut-off pressure PAB, a rapid and/or abrupt filling of the container 100 may be achieved and the filling process may be rapidly terminated.

Correspondingly, until the filling valve 5*a* is closed the filling product is at an overpressure relative to the pressure in the container 100 to be filled so that a rapid inflow of the filling product is possible. Moreover, by the pressure difference and the filling product flow associated therewith, which is oriented into the container 100, a backflow of residual gas from the container 100 into the filling product feed 5 may be avoided. Thus the filling process of the container 100 may be carried out under pressure conditions which are based on the determination of the cut-off pressure PAB, so that the predetermined filling volume may be accurately achieved. Correspondingly, the gas lock set forth above may also be dispensed with, since due to the pressure difference which is always present and the filling product flow, which is oriented exclusively into the container 100, it is not possible for residual gas to flow back.

Figure 1C:
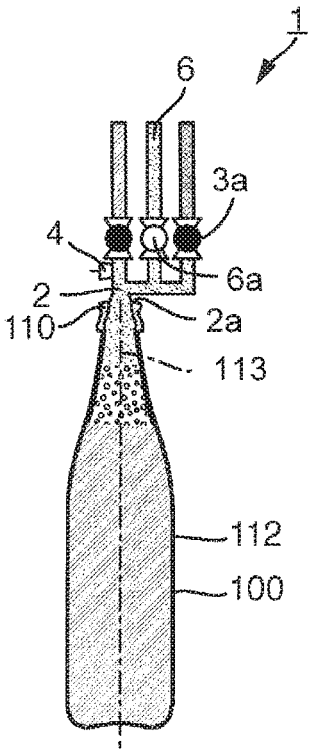
FIG. 1*c* shows the filling device with the container of FIGS. 1*a* and 1*b* in a third state.

In FIG. 1*c* a further step of the method is shown, in which the filling device 1 for filling the container 100 with the filling product via a pressurizing gas device 6, which has a pressurizing gas valve 6*a*, is switched to the filling product line 2 in order to force out the residual filling product from the filling product line 2 and to force the foamed filling product into the interior 112 of the container 100 to be filled. In this manner, the filling product line 2 may be substantially emptied of filling product which is still present in foamed form. Moreover, the filling product may be introduced into the interior 112 of the container 100 to be filled such that the head space 113 also substantially remains free of filling product foam.

Figure 2:
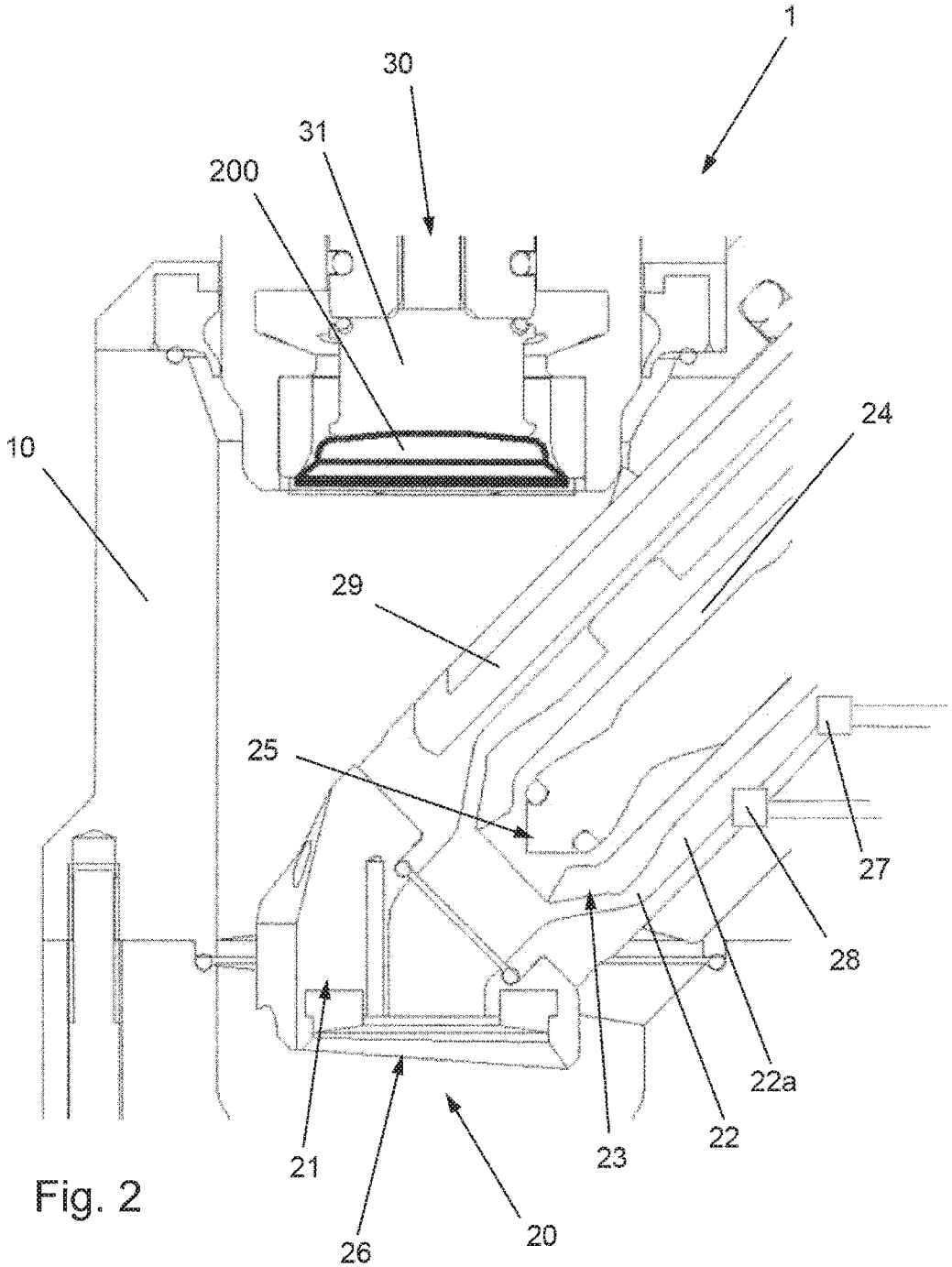
FIG. 2 shows a schematic view of a filling device for filling and closing a container according to a further embodiment.

A development of the filling device 1 according to FIGS. 1*a*, 1*b* and 1*c* is shown in FIG. 2. FIG. 2 shows a detail of a filling device 1 for filling a container (not shown in FIG. 2) with a filling product and closing the container with a closure 200 in a beverage filling system.

The filling device 1 has a filling member 20 which in the process state shown in FIG. 2 protrudes into a treatment chamber 10. The filling member 20 comprises, received in a filling member housing 21: a filling product line 22; a filling valve 23 which is arranged at the lower end of the filling product line 22, i.e. located downstream; a gas line 24; and a gas valve 25 which is arranged at the lower end of the gas line 24. Sensors, such as for example a pressure gauge in the filling product line 22 or gas line 24, are not shown in FIG. 2 for the sake of clarity.

Via the gas line 24 and the gas valve 25 the container may be flushed and/or pressurized with a gas, for example inert gas, nitrogen and/or carbon dioxide. Moreover, the container interior may also be set thereby to a desired pressure, for example evacuated. The gas line 24 may have a multichannel construction, for example by means of a tube-in-tube construction it may comprise a plurality of gas lines in order to separate physically the feed of one or more gases into the container and/or the discharge of gas from the container, if required.

The gas valve 25 comprises, for example, a gas valve cone and a gas valve seat which are designed to regulate the gas throughflow. To this end, the gas valve cone is switchable via an actuator, not shown.

The filling product line 22 is designed as an annular line which extends substantially concentrically to the gas line 24. The filling valve 23 comprises, for example, a filling valve cone and a filling valve seat which are designed to regulate the throughflow of the filling product. The filling valve 23 is designed to permit a complete shut off of the filling product flow. In the simplest case the filling valve 23 has two positions, an open position, and a fully closed position. To this end, the filling valve 23 is switchable via an actuator, not shown.

The actuation of the gas valve 25 and the filling valve 23 take place via actuators, not shown in more detail. It should be mentioned that the gas valve 25 and the filling valve 23 may be operatively connected together, so that for example an actuator may be designed for common use, in order to simplify the construction of the filling member 20 and to increase the reliability.

The filling member 20 has at the outlet end of the media a mouth section 26 which is designed such that the container mouth may be moved sealingly against the mouth section 26. To this end, the mouth section 26 has a centering bell with a suitably shaped contact seal. The filling member 20 with the mouth section 26 is designed for so-called wall filling in which the filling product flows downwardly on the container wall after exiting from the mouth section 26, the filling product line 22 and the mouth section 26 are designed or have corresponding means such that the filling product is swirled during the bottling process, whereby the filling product is driven outwardly due to centrifugal force and after exiting from the mouth section 26 flows downwardly in a spiral motion.

Optionally, the filling member 20 has one or more, at least two, metering valves 27, 28 which open into a metering chamber 22*a*, whereby a rapid product changeover may be implemented, substantially without resetting time.

The metering valves 27, 28 are preferred designs and/or embodiments of metering supply lines. In other words: in specific embodiments in which the introduction and any dimensioning of the metering component(s) in the metering chamber 22*a* is implemented by external means relative to the filling member 20, optionally the metering valves 27, 28 may be dispensed with so that, for example, only corresponding metering lines or metering channels open into the metering chamber 22*a*.

The metering chamber 22*a* may be a portion or suitably shaped part of the filling product line 22. Via the metering valves 27, 28, to which corresponding metering lines are connected, a main component, for example water or beer, one or more metered components, for example syrup, pulp, flavorings, etc. may be metered into the metering chamber 22*a* via the filling product line 22.

The filling member 20 is designed to be at least partially movable so that the arm-like portion of the filling member 20 shown in FIG. 2 may be retracted into the treatment chamber 10 and either pulled back therein or partially or even completely removed therefrom. As a result, for the bottling process it is possible to press the container mouth against the mouth section 26 of the filling member 20 and subsequently after terminating the bottling process to pull back the filling member 20 to such an extent that the container in the treatment chamber 10 is able to be closed.

In order to ensure the mobility of the filling member 20, without the atmosphere of the treatment chamber 10 being subjected to uncontrolled external influences, means for sealing, which are not shown in FIG. 2, are correspondingly provided. For example, after terminating the bottling process the treatment chamber pressure may be greater than the pressure of the external surroundings which in this case does not have to be atmospheric pressure, whereby a penetration of contaminants into the treatment chamber 10 may be virtually excluded. Alternatively or additionally, the treatment chamber 10 may be located in a clean space or form such a clean space.

In the present embodiment, the filling device 1 also has a closure member 30 for closing the container. The closure member 30 has a closure head 31 which protrudes into the treatment chamber 10 and in the present embodiment is movable substantially vertically. As in the case of the filling member 20 the closure member 30 is sealed relative to the wall of the treatment chamber 10 in order to avoid a contamination of and/or uncontrolled adverse effects on the atmosphere in the interior of the treatment chamber 10 due to external influences.

The closure member 30 is configured and designed to receive and to hold a closure 200 on the closure head 31. To this end, the closure head 31 may have a magnet, whereby in a structurally simple manner a closure 200, in particular when this is a metal bottle cap, may be received in a centered manner and positioned on the container mouth for closing the container. Alternatively, the closure 200 may be grasped, held, and positioned on the container mouth by suitable gripping or clamping means, so that the concept set forth herein is also applicable for plastics closures, screw closures, etc.

The closure head 31 is designed to be movable in the upward/downward direction, wherein this closure head is arranged substantially coaxially to the container mouth in order to be able to apply the closure 200 reliably onto the container.

The transfer of a closure 200 to the closure head 31 may be carried out in different ways. For example, for each filling/closing cycle, in a first step a closure 200 may be introduced, for example, from a sorting apparatus and a feed channel into the treatment chamber 10. To this end, the treatment chamber 10 may be part of the closure member 30 and perform a relative movement to the closure feed, for example the feed channel or a transfer arm, wherein the closure head 31 selects and holds a closure 200 from the closure feed.

It should be mentioned that the closing of the container may also take place at other points. In particular, in the case of carbon dioxide-containing filling products, however, the closing takes place at overpressure, immediately after the filling process and in the treatment chamber 10, as described hereinafter and as already described relative to FIGS. 1*a*, 1*b* and 1*c*.

For filling the container, this container is raised relative to the treatment chamber 10, the container mouth is introduced into the treatment chamber 10 and sealed relative to the treatment chamber 10. The container mouth is sealingly pressed against the mouth section 26 of the filling member 20 extended into the filling position. The mouth section 26 of the filling member 20 thus marks the end position of the container lifting stroke. The closure head 31 receives the closure 200 and moves into the treatment chamber 10. The seal of the treatment chamber 10 relative to the surroundings and relative to the container and/or the mouth region thereof may take place by inflating one or more seals. The treatment chamber 10 itself does not perform a lifting movement.

During the filling process, a gas is fed into the treatment chamber 10. By means of such a parallel execution the entire process may be optimized. During the filling process, the treatment chamber 10 may be sealed on all sides, whereby a suitable internal pressure may be created in the treatment chamber 10. In the case of carbon dioxide-containing filling products, this corresponds to the filling pressure or saturated pressure of the carbon dioxide, whereby a foaming or foaming over of the filling product after terminating the filling process is effectively prevented.

The gas for the treatment chamber 10 may be supplied by means of a valve, not shown in FIG. 2, in the wall of the treatment chamber 10. Alternatively or additionally, the gas supply may be at least partially integrated in the filling member 20. Thus to this end the filling member 20 according to the present embodiment has a treatment chamber gas line 29. The treatment chamber gas line 29, in particular the outlet thereof into the treatment chamber 10, may be designed such that the exiting gas flow strikes against the lower side of the closure 200 when the filling member 20 is in the filling position. In this manner, at the same time a cleaning of the closure 200 is carried out during the filling process, carbon dioxide is used as the gas but a different medium, such as for example sterile air, may also be used.

If the container is now filled and the interior of the treatment chamber 10 brought to the desired pressure, the filling member 20 is pulled back and the closure head 31 continues its downward movement until, when reaching the container mouth, the container mouth is closed.

A preferred process for the abrupt filling and closing of the container with a filling product may be carried out as follows:

a) evacuating the container to a negative pressure Plow;

b) filling the filling product into the container, at an overpressure;

c) generating an overpressure Phigh in the treatment chamber 10 and optionally in the head space of the container in order to avoid a foaming and foaming over of the filling product when the filling member 20 is released from the container mouth;

d) releasing the filling member 20 from the container mouth;

e) applying the closure 200 onto the container mouth and closing the container without previously depressurizing to ambient pressure;

f) venting the treatment chamber 10 and removing the container for further processing (for example labeling, packaging, etc.).

As shown with reference to the embodiment of FIGS. 1*a*, 1*b* and 1*c*, the terms "negative pressure" and "overpressure" are also initially to be understood herein relative to one another. However, the negative pressure $P_{low}$ after the evacuation in step a) is below atmospheric pressure (=normal pressure). The overpressure $P_{high}$ generated in step c) may correspond to atmospheric pressure but is above atmospheric pressure.

Thus before introducing the filling product the container is evacuated, at a negative pressure Plow with an absolute pressure of 0.5 to 0.05 bar, 0.3 to 0.1 bar, particularly approximately 0.1 bar, the overpressure of the filling product and the overpressure Phigh of the treatment chamber 10, which are equal, are above atmospheric pressure, for example at an absolute pressure of 1.1 bar to 6 bar. In this manner, the container is evacuated such that when filled with the filling product, substantially no gas is displaced by the filling product, and correspondingly also no gas has to flow out of the interior of the container. Instead, the entire mouth cross section of the container may be used for introducing the filling product. In other words, during the filling process, only a filling product flow which is oriented into the container is present, rather than an opposing fluid flow.

The filling process, in particular the variants for terminating the filling process, in the case of the filling device with an integrated closure function according to the embodiment of FIG. 2, may also be carried out as set forth relative to the embodiment of FIGS. 1*a*, 1*b* and 1*c*.

During the filling process, due to the pressure-tight bottling process, the filling level may not be measured or only with a significant structural effort, and the bottling process terminated on the basis of the filling level reached. A potential correction to the filling level is even more difficult to integrate in the technology for abrupt filling. If an influence variable changes, such as for example the negative pressure Plow, the temperature or CO2 concentration of the filling product, it is possible that the containers are underfilled or overfilled.

Figure 3:
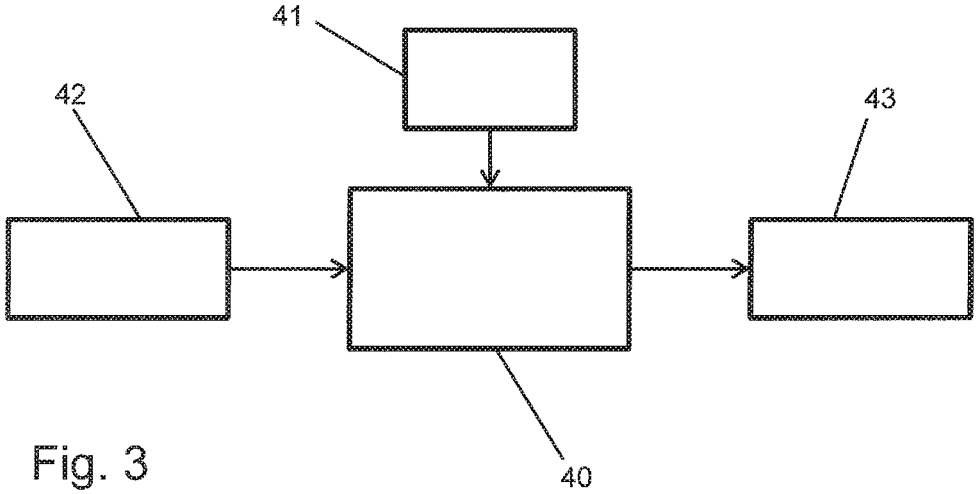
FIG. 3 shows a block diagram of a control apparatus which undertakes a pre-calculation for achieving a desired filling level and/or a desired filling volume.

In order to improve the accuracy of the filling level and/or the bottled volume, the filling device 1 has a control apparatus 40 which is shown schematically in the block diagram of FIG. 3.

The control apparatus 40 is an electronic data processing apparatus which is designed to minimize fluctuations of a target variable 41, the filling level and/or the filling volume, by means of a calculation model. The control apparatus 40 may be implemented in different ways: thus for example, it may be constructed in a centralized or decentralized manner from one or more computer systems which communicate with one another, communicate in a wireless or wired manner, be programmable, etc. The control apparatus 40 is designed to receive measurement data of influence variables 42 from sensors, for example from the pressure gauge 4, a CO2 sensor for determining the CO2 concentration in the filling product, a temperature sensor for determining the filling product temperature and the like. The measurement data may be transmitted at specific time intervals, for example cyclically, before each bottling process or all n>1 bottling processes, continuously or regulated as required. The transmission may take place in a wireless or wired manner. The data are processed by means of a calculation model and data and/or signals are generated as outputs by the control apparatus 40 to components influencing the filling process (actuators, valves, pumps, and the like).

The influence variables 42, which are determined by sensors or in a different manner, may be divided into geometric, process-technical, and product-dependent variables. Amongst the product-dependent variables, for example, are the temperature and/or the CO2 content of the filling product. Amongst the process-technical variables, for example, are the vacuum pressure, which is used for producing the negative pressure Plow. Amongst the geometric variables, for example, are properties of the container, such as for example the volume thereof.

If the influence variables 42 are known, the filling process may be controlled by one or more output variables 43 being calculated for the desired target variable 41, i.e. the filling level to be reached or the volume to be bottled. Output variables 43 relate to adjustable parameters, such as for example the overpressure of the filling product, at which the bottling process is carried out, and/or the negative pressure Plow of the evacuated container and/or the cut-off pressure PAB and/or a dead space volume which varies the volume to be bottled.

Those influence variables 42 that are process-dependent and variable are intended to be measured during the course of the process and influence the calculation model of the filling process. The aim, therefore, by means of the calculation model is to be able to react to the parameters of the filling process which are measured, for example at defined time intervals, in order to minimize fluctuations of the target variable 41, i.e. filling level or filling volume.

The calculation model calculates, for example, according to a first variant for each measuring point a required filling pressure for a defined target variable 41. If the current filling pressure deviates from the calculated reference pressure, this is recalculated. The current filling pressure, for example, may be determined by a pressure gauge in a product bowl which delivers the filling product to the respective filling stations and/or by the pressure gauge 4 in the filling product line 2, 22.

As an alternative procedure, the negative pressure Plow may also be calculated and regulated at constant filling pressure. In this case, the negative pressure in the container and/or in the vacuum line 3 may be measured and utilized.

According to a third variant, the dead space volume in the filling product line 2, 22 is kept variable, whereby in turn a constant filling level and/or a constant filling volume in the container may be achieved. The dead space volume, for example, may be varied by a punch and/or a piston which is movable in a corresponding portion of the filling product line 2, 22 or in a chamber branching off therefrom.

According to a development, the filling level thus achieved and/or the filling volume thus achieved after the bottling process may be measured at specific intervals, intermittently or continuously, in order to optimize the calculation model. Thus, for example, any variation in the head space volume by degassing the gases contained in the filling product may be determined by a filling level measurement and considered for subsequent bottling processes in the calculation model. If too much degassing takes place, this may be compensated, for example, by adapting the temperature of the filling product to be bottled.

By pre-calculating one or more output variables 43, such as for example the filling pressure, for a defined target variable 41, such as for example the filling level, containers may be produced with a uniform filling level and/or uniform filling volume, even under variable process conditions. Fluctuations of influence variables 42 of the filling process which occur, such as for example the temperature of the filling product and/or the vacuum pressure, are measured, at defined time intervals and the filling pressure, vacuum pressure and/or the dead space volume calculated and adapted by means of the calculation model. Thus the process parameters are dynamically adapted to fluctuations in order to counteract changes to the filling level or the filling volume. The calculation model additionally permits the production to be started up without significant fluctuations, since it is possible to react to dynamic changes, such as for example the gradual heating up of the filling product in the product bowl.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

If applicable, all of the individual features which are shown in the embodiments may be combined together and/or exchanged without departing from the scope of the invention.

The invention claimed is:

1. A method for filling a container with a filling product in a beverage filling system, the method comprising:

determining one or more changeable influence variables that influence a target variable of a filling process, the target variable being a filling level and/or a filling volume;

receiving the influence variables by way of a control apparatus;

calculating, by the control apparatus, at least one output variable based on the received influence variables using a calculation model, wherein the calculation model undertakes a pre-calculation as to which value is to be anticipated for the target variable as a function of the received influence variables and determines the at least one output variable from the value anticipated for the target variable; and filling the container as a function of the at least one output variable.

2. The method of claim 1, wherein the filling the container comprises:

evacuating the container to be filled to a negative pressure $P_{low}$ in a range of an absolute pressure of 0.5 to 0.05 bar; and filling the filling product into the container at an overpressure in a range of an absolute pressure of 1 bar to 9 bar.

3. The method of claim 2, wherein the filling of the container is terminated by taking into account a pressure curve in the container during the filling such that the filling of the container is terminated in response to a predetermined cut-off pressure (PAB) in the container being reached or a predetermined rise in pressure in the container being reached.

4. The method of claim 1, wherein the changeable influence variables comprise one or more of: a temperature of the filling product to be bottled, a $CO_2$ content of the filling product to be bottled, a negative pressure $P_{low}$ of an evacuated container, and an overpressure at which the filling product is provided.

5. The method of claim 1, wherein the at least one output variable comprises one or more of: an overpressure of the filling product at which the filling process is carried out, a negative pressure $P_{low}$ of an evacuated container, a cut-off pressure (PAB), and a dead space volume.

6. The method of claim 1, wherein the one or more changeable influence variables are determined at defined time intervals and received by the control apparatus.

7. The method of claim 1, wherein the calculating the at least one output variable is carried out: for each filling process, through regulation that is based on the filling process, at defined time intervals, or at filling intervals.

8. The method of claim 1, wherein after terminating the filling process, the filling level or the filling volume in the filled container is determined and the calculation model is adjusted as a function thereof.

9. The method of claim 1, wherein for determining an end of the filling process neither the filling level nor the filling volume are determined and/or utilized.

10. The method of claim 1, wherein the calculating the at least one output variable is carried out such that the target variable adopts a particular value and remains substantially constant across a plurality of filling processes.

11. A filling device for filling a container with a filling product in a beverage filling system, the filling device comprising:

a filling member with a filling product line configured to introduce the filling product into the container;

a sensor configured to determine one or more changeable influence variables that influence a target variable of a filling process, the target variable being a filling level and/or a filling volume; and a control apparatus configured to:

receive the determined influence variables, calculate at least one output variable based on the received influence variables using a calculation model, wherein the calculation model undertakes a pre-calculation as to which value is to be anticipated for the target variable as a function of the received influence variables and determines the at least one output variable from the value anticipated for the target variable, and activate the filling member such that the container is filled as a function of the at least one output variable.

12. The filling device of claim 11, wherein the filling device is configured to:

evacuate the container to be filled to a negative pressure $P_{low}$ in a range of an absolute pressure of 0.5 to 0.05 bar, provide the filling product at an overpressure in a range of an absolute pressure of 1 bar to 9 bar, and introduce the filling product into the container.

13. The filling device of claim 12, wherein the control apparatus is configured to terminate the filling process of the container based on a pressure curve in the container during the filling such that the filling of the container is terminated in response to a predetermined cut-off pressure (PAB) in the container being reached or a predetermined rise in pressure in the container being reached.

14. The filling device of claim 11, wherein the sensor configured to determine the one or more changeable influence variables comprises one or more of:

a temperature sensor for measuring a temperature of the filling product to be bottled, a $CO_2$ sensor for measuring $CO_2$ content of the filling product to be bottled, a pressure gauge sensor for measuring a negative pressure $P_{low}$ of an evacuated container, and a pressure gauge sensor for measuring an overpressure at which the filling product is provided.

15. The filling device of claim 11, wherein the at least one output variable comprises one or more of: an overpressure of the filling product at which the filling process is carried out, a negative pressure $P_{low}$ of an evacuated container, a cut-off pressure (PAB), and a dead space volume.

16. The filling device of claim 11, wherein the filling product line comprises a changeable dead space volume that is variable by an output variable of the control apparatus.

17. The filling device of claim 11, wherein the control apparatus is configured to receive the one or more changeable influence variables at defined time intervals and to carry out the calculate at least one output variable for each filling process, through regulation that is based on the filling process, at defined time intervals, or at filling intervals.

18. The filling device of claim 11, wherein the control apparatus is configured such that the calculate at least one output variable is performed using the calculation model such that the target variable adopts a particular value and remains substantially constant across a plurality of filling processes.

* * * * *